US005300342A

United States Patent [19]

Long

[11] Patent Number: 5,300,342

[45] Date of Patent: Apr. 5, 1994

[54] PRODUCT BAND

[75] Inventor: John D. Long, Scarborough, Canada

[73] Assignee: Longford Equipment International Limited, Scarborough, Canada

[21] Appl. No.: 889,245

[22] Filed: May 28, 1992

[51] Int. Cl.[5] ..... B32B 9/00

[52] U.S. Cl. ..... 428/57; 428/40; 428/61; 428/343; 428/913

[58] Field of Search ..... 428/192, 343, 349, 57, 428/913, 61, 40

[56] References Cited

U.S. PATENT DOCUMENTS 4,741,935 5/1988 Sheeham, Jr. ..... 428/35

*Primary Examiner*—Patrick J. Ryan
*Assistant Examiner*—Abraham Bahta

[57] ABSTRACT

A paper or plastic band for a product, such as a newspaper, comprises a single integral strip with the inner faces of the two end portions of the strip being joined such that the strip forms a loop with the joined end portions forming a tag projecting outwardly from the loop. In another embodiment, the tag is folded over to lie flat against the loop and is joined in this position in order to reinforce the joint between the two end portions.

5 Claims, 3 Drawing Sheets

PRODUCT BAND

BACKGROUND OF THE INVENTION

1. Field of the Invention

This invention relates to a band for a product.

2. Description of the Related Art

A product, such as a magazine or a newspaper, may be banded in order to hold it together or to hold it in a folded state. A common form of plastic and paper banding comprises a strip which is looped around the product with the ends of the strip overlapped and joined such that the outer face of the underlying end is joined to the inner face of the overlapping end. With this form of banding, the strength of the joint between the ends is limited. This invention seeks to overcome drawbacks of known product bands.

SUMMARY OF THE INVENTION

According to the present invention, there is provided a band for a product comprising a single strip having side and end edges and inner and outer faces, the inner face of portions of said strip proximate said end edges being joined together by an activated adhesive which coats said portions such that said strip forms a loop and joined end portions which project outwardly from said loop, the inner face of said paper strip interior of said joined end portions being at least substantially free of activated adhesive.

According to another aspect of the invention, there is provided a band for a product comprising a strip having side and end edges and inner and outer faces, the inner face of portions of said strip proximate said end edges being joined together by an activated adhesive which coats said portions such that said strip forms a loop and joined end portions which are attached to the outer face of said strip along a portion of said loop whereby said joined end portions lie flat against the outer face of said strip along a portion of said loop and reinforce the joint between said joined end portions, the inner face of said paper strip interior of said joined end portions being at least substantially free of activated adhesive.

BRIEF DESCRIPTION OF THE DRAWINGS

In the figures which disclose example embodiments of the invention.

DESCRIPTION OF THE PREFERRED EMBODIMENTS

Figure 1:
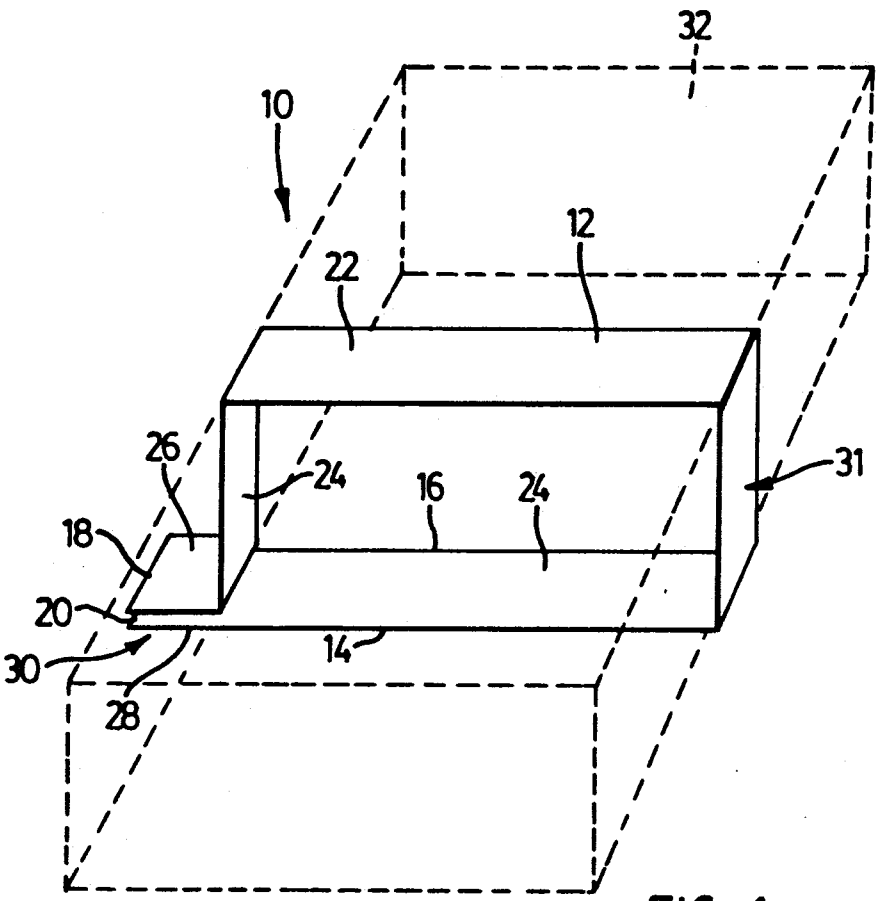
FIG. 1 is a perspective view of a product band made in accordance with this invention.

With reference to FIG. 1, a product band 10 comprises a single integral strip 12 of paper having side edges 14, 16, end edges 18, 20, outer face 22 and inner face 24. The inner faces 24 of strip portion 26 proximate end edge 18 and strip portion 28 proximate the end edge 20 are joined together so that the strip forms a loop 31 with the joined end portions 26, 28 projecting outwardly from the loop as a tag 30. The looped portion 31 of the band surrounds a product illustrated in phantom at 32.

The inner face 24 of the paper strip 12 has a heat sensitive adhesive coating thereon. Accordingly, by pressing strip portions 26, 28 together while applying heat, strip portions 26, 28 are joined together. Because the strip portions 26, 28 project outwardly from the looped portion 31 of the paper strip, they may be subjected to high pressure and heat without affecting the loop 31 or the product 32.

Figure 2:
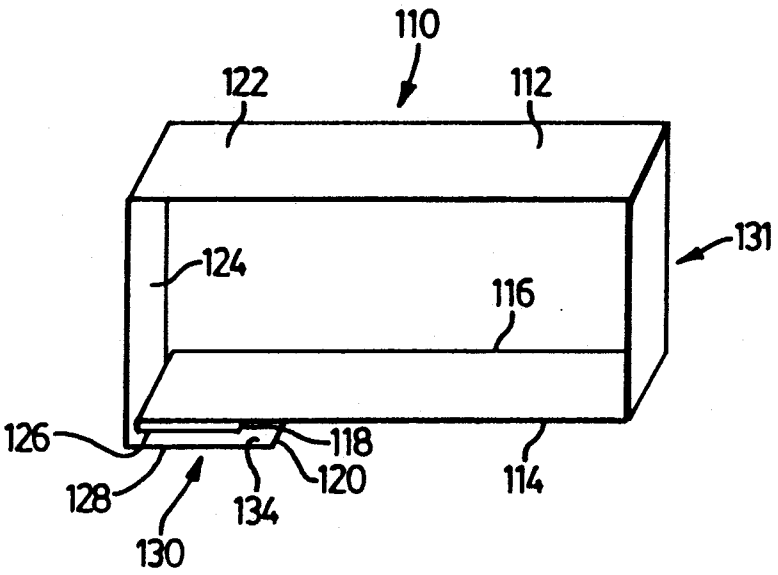
FIG. 2 is a perspective view of another embodiment of a product band made in accordance with this invention.

FIG. 2 illustrates an alternate embodiment of the product band of this invention. Turning to FIG. 2, product band 110 comprises strip 112 having side edges 114, 116, end edges 118, 120, outer face 122, and inner face 124. The inner faces of strip portions 126, 128 proximate the end edges 118, 120, respectively, are joined such that the strip forms a loop 131 and such that end edge 120 projects beyond end edge 118 so as to expose a portion 134 of the inner face of the strip adjacent end edge 120. Joined end portions 126, 128 and exposed strip portion 134 comprise a tag 130. This tag is folded to lie flat against the outer face 122 of the loop 131 and is attached in this position in order to reinforce the joint between the joined strip portions 126, 128.

The strip has a layer of heat sensitive adhesive coated on its inner face 124 so that the end portions 126, 128 may be joined by being pressed together with heat. Thereafter, a resulting tag 130 may be folded flat against the outer surface 122 of the loop under pressure with heat so that the exposed strip portion 134 adheres to the outer face 122 of the loop.

Figure 3:
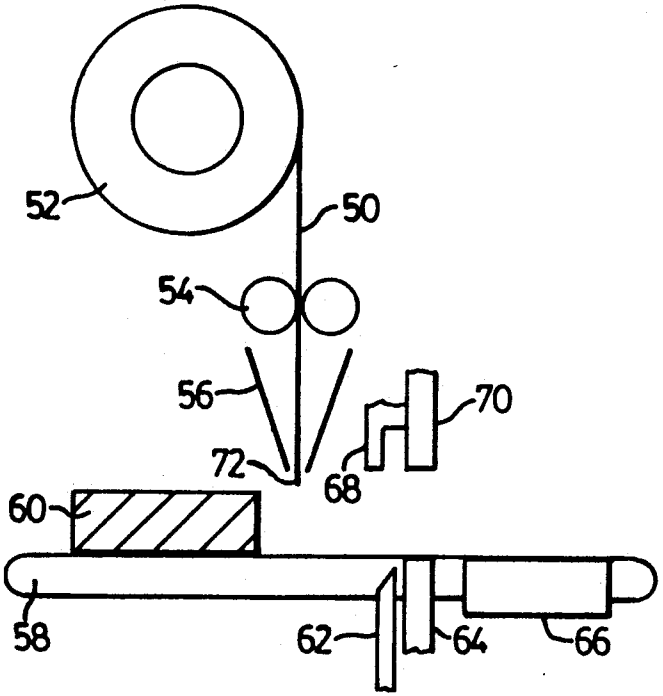

Turning to the FIG. 3 which illustrates a machine to band a product with the band of FIG. 1, a strip of paper 50 extends from a roll of paper strip 52 through driving pinch rollers 54 and guides 56. A product conveyor 58 conveys products 60 past, in consecutive order, knife 62, sealing pad 64, and vacuum pad 66. An anvil 68 with associated sealing head 70 are positioned over the knife 62 and sealing pad 64, respectively.

Figure 5:
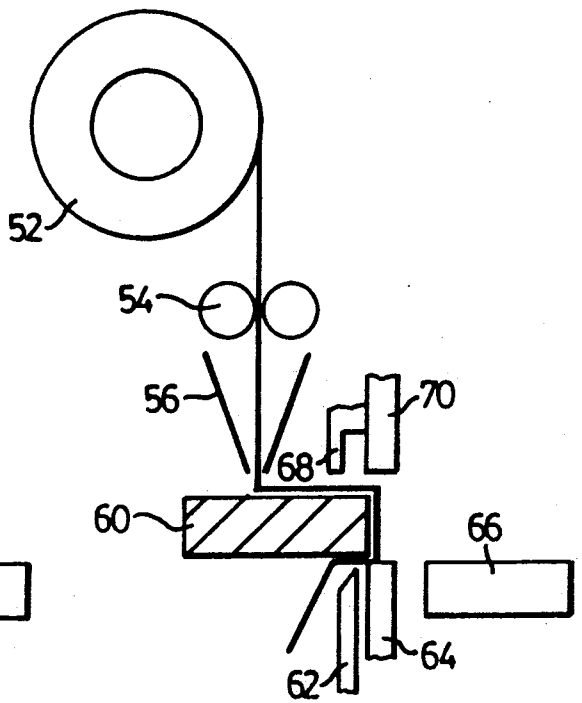
FIGS. 3 through 7 are schematic views of a machine for banding a product with the product band of FIG. 1.
Figure 4:
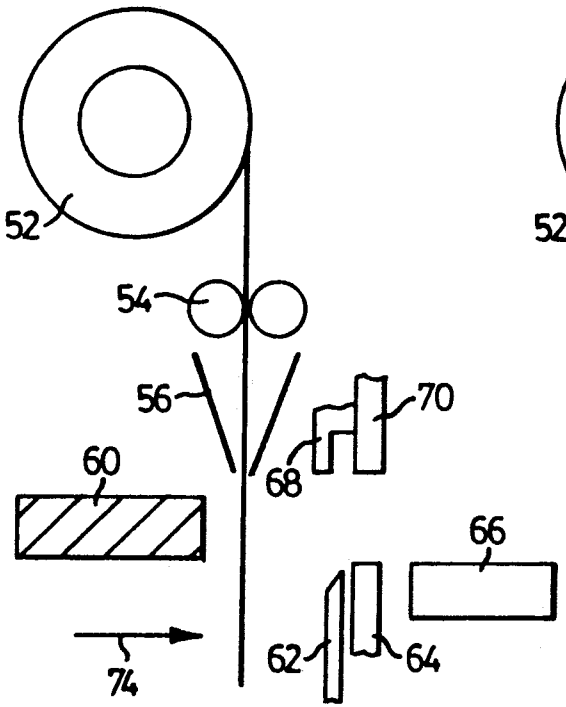
Figure 7:
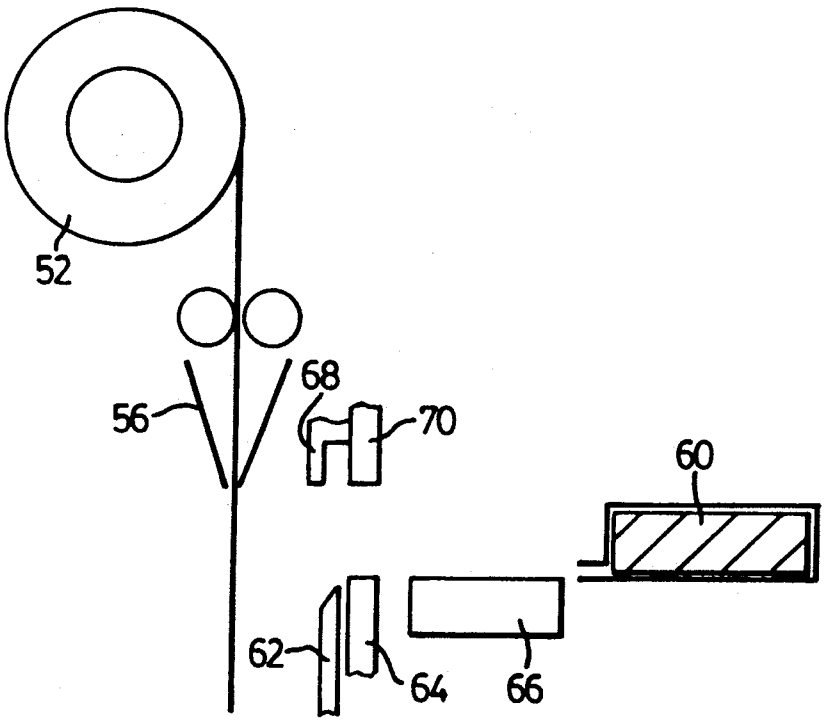
Figure 6:
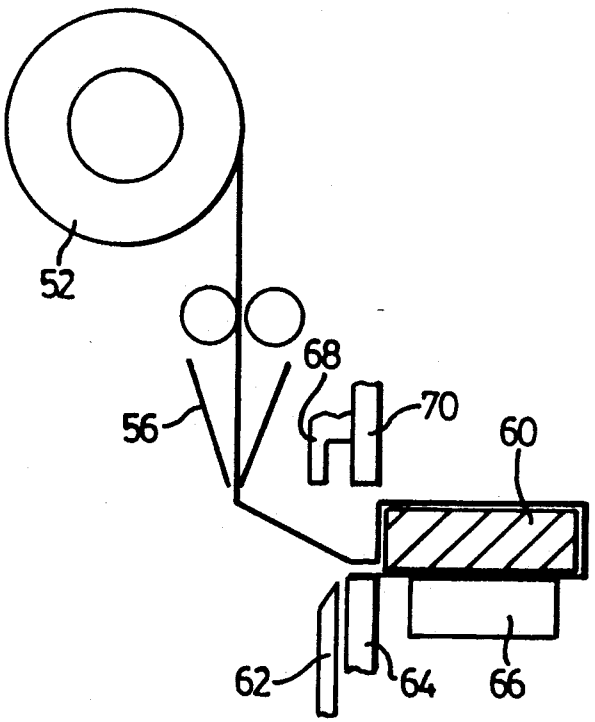

With reference to FIGS. 3 through 7, the machine operates as follows. Paper driving pinch rollers 54 drive a strip of paper 50 from the roll of paper strip 52 so that the leading edge 72 thereof extends to a position below product conveyor 58 (FIG. 4). The product 60 is then moved in a downstream direction 74 toward knife 62 and pushes a medial portion of the the strip 50 ahead of it; as the strip 50 rides over the sealing pad 64, the strip folds around the leading edge of the product 62 (FIG. 5). As the product continues in the downstream direction on conveyor 58, paper drives 54 pay out further paper strip from the roll and the portion of the strip underlying product 62 reaches, and is thereafter held by, vacuum pad 66. FIG. 6 illustrates this stage in the operation of machine. When the machine reaches the stage of FIG. 6, sealing head 70 is brought against sealing pad 64 in order to push overlapping portions of the strip of paper 50 together under heat so as to adhere these portions. Anvil 68 moves with sealing head 70 and when the sealing head contacts the sealing pad 64, knife 62 projects upwardly into abutment with the anvil in order to sever the strip 50 of paper. In this way, the product is banded and the loose end of the continuous strip of paper extending from roll 52 is free to drop away from the knife and down below product conveyor 58 so that the machine is again ready for the next product (FIG. 7).

The machine of FIGS. 3 through 7 may be readily modified to produce the band of FIG. 2 firstly by repositioning knife 62 slightly upstream in order to ensure that one end of the resulting product band extends beyond the other end. This leaves a tag which may then be folded and pressed against the looped portion of the band under heat in order to adhere the tag to the looped portion of the band.

The loops 31 and 231 are illustrated as being rectangular in cross-section with the tag 30, 230 at one corner of this rectangular cross-section. Alternatively, the tag 30, 230 could be formed medially of one of the sides of this rectangular cross-sectional shape. Also, the loops 31, 231 could have other than a rectangular shape if the product around which it was formed had another cross-sectional shape.

The bands of FIGS. 1 and 2 have been described as paper bands but may equally be plastic bands. In this regard, the roll of paper strip 50 of FIG. 3 could be replaced by a roll of plastic strip in order to band products with plastic bands.

Other modifications would be apparent to those skilled in the art and, accordingly, the invention is defined in the claims.

What is claimed is:

1. A band for a product comprising a single strip having side and end edges and inner and outer faces, the inner face of portions of said strip proximate said end edges being joined together by an activated adhesive which coats said portions such that said strip forms a loop and joined end portions which project outwardly from said loop, the inner face of said paper strip interior of said joined end portions being at least substantially free of activated adhesive.

2. The band of claim 1 wherein said strip is a paper strip having a heat sensitive adhesive on its inner face.

3. A band for a product comprising a strip having side and end edges and inner and outer faces, the inner face of portions of said strip proximate said end edges being joined together by an activated adhesive which coats said portions such that said strip forms a loop and joined end portions which are attached to the outer face of said strip along a portion of said loop whereby said joined end portions lie flat against the outer face of said strip along a portion of said loop and reinforce the joint between said joined end portions, the inner face of said paper strip interior of said joined end portions being at least substantially free of activated adhesive.

4. The band of claim 3 wherein said strip is a paper strip having a heat sensitive adhesive on its inner face.

5. The band of claim 4 wherein said end portions are joined such that one end edge of said strip projects beyond the other end edge of said strip so as to expose a portion of the inner face of said strip at said one end edge and wherein said exposed portion of said inner face is adhered to the outer face of said loop.

* * * * *